US006849055B1

(12) United States Patent
Williams

(10) Patent No.: US 6,849,055 B1
(45) Date of Patent: Feb. 1, 2005

(54) RIBBED TOWEL WITH HANDLES

(76) Inventor: Alex Williams, 1881 Ivy Hall Rd., Charleston, SC (US) 29407

( * ) Notice: Subject to any disclaimer, the term of this patent is extended or adjusted under 35 U.S.C. 154(b) by 0 days.

(21) Appl. No.: 10/665,538

(22) Filed: Sep. 19, 2003

(51) Int. Cl.[7] ..... A61H 19/00

(52) U.S. Cl. ..... 601/137; 601/138; 401/8; 15/208

(58) Field of Search ..... 601/137, 138; 428/72, 76; 15/208, 222; 401/6, 8, 201

(56) References Cited

U.S. PATENT DOCUMENTS

| | | | | | |
|---|---|---|---|---|---|
| 2,008,990 | A | * | 7/1935 | Toblas | 15/222 |
| 3,124,827 | A | * | 3/1964 | Hull | 401/201 |
| 3,860,349 | A | | 1/1975 | Scott | |
| 3,959,841 | A | | 6/1976 | Horne | |
| 3,977,796 | A | | 8/1976 | Gillespie et al. | |
| 4,196,490 | A | | 4/1980 | Jonzon | |
| 4,915,096 | A | * | 4/1990 | Winstone et al. | 601/143 |
| D318,972 | S | | 8/1991 | Chestnut | |
| 5,486,064 | A | | 1/1996 | Schulte | |
| 5,509,164 | A | | 4/1996 | Weill | |
| 5,545,456 | A | | 8/1996 | Suida | |
| D380,119 | S | | 6/1997 | Gonzalez | |
| D381,545 | S | | 7/1997 | Muttick et al. | |
| D385,743 | S | | 11/1997 | Eldridge | |
| D414,645 | S | | 10/1999 | Cooper | |
| 6,227,742 | B1 | | 5/2001 | Corn et al. | |
| 6,505,367 | B2 | | 1/2003 | Griffin et al. | |
| 2002/0197097 | A1 | * | 12/2002 | Rabbani | 401/201 |

* cited by examiner

*Primary Examiner*—Michael A. Brown
(74) *Attorney, Agent, or Firm*—Harleston Law Firm, LLC; Kathleen M. Harleston

(57) ABSTRACT

A ribbed towel device for massaging and/or drying hard-to-reach areas of the body during or after bathing includes:

(a) an elongate body of an absorbent material, the elongate body having opposite lateral ends;

(b) a handle at each opposite lateral end of the elongate body;

(c) a plurality of spaced-apart, rod-shaped pockets in the elongate body;

(d) a plurality of massage bars, each one being inserted in one of the pockets; and preferably (e) end seams extending transversely across opposite ends of the elongate body; and (f) a channel at each of the opposite ends of the elongate body, each channel being formed by the end seams; wherein each handle extends through one of the channels.

20 Claims, 5 Drawing Sheets

RIBBED TOWEL WITH HANDLES

BACKGROUND OF THE INVENTION

1. Technical Field

The present towel device relates generally to bathing and massaging devices, and more particularly to a ribbed towel device with handles for massaging and/or drying the back area or any other hard-to-reach part of the body during or after bathing or showering.

2. Background Information

Since the inception of bathing thousands of years ago, numerous bathing accessories have emerged to make bathing easier, more pleasurable, and efficient. Stores carry all types of wash cloths, towels, sponges, and scrubbers. For example, devices for washing the back and other areas of the body are especially plentiful and well known in the art. U.S. Pat. No. 6,227,742 issued to Corn et al., U.S. Pat. No. 5,545,456 issued to Suida, U.S. Pat. No. 5,509,164 issued to Weill, U.S. Pat. No. 5,468,064 issued to Schulte, U.S. Pat. No. 4,196,490 issued to Jonzon, U.S. Pat. No. 3,977,796 issued to Gillespie et al., and U.S. Pat. No. 3,860,349 issued to Scott disclose such devices. U.S. Pat. No. 3,959,841 issued to Home even describes a device for applying liquid preparations, such as lotions and creams, on hard-to-reach parts of the user's body, such as the back.

Although a multiplicity of gadgets for washing and otherwise treating hard-to-reach areas of the body exist, there appear to be no inventions that specifically dry and massage these hard-to-reach areas at the same time. Only U.S. Pat. No. 6,505,367 issued to Griffin et al. makes known a bath towel device for picking up, holding, and drying infants and other small children, but this towel does not provide massaging action. Many massaging apparatus are publicized and marketed, but none of these are also capable of drying action. A conventional bath towel only imparts a rubbing/drying action, not a massaging action, to body parts. Thus, there is a need for a new and improved towel device that both massages and dries the back and other difficult-to-reach parts of the body during and/or after bathing.

BRIEF SUMMARY OF THE INVENTION

A ribbed towel device for massaging and/or drying hard-to-reach areas of the body during or after bathing includes:

(a) an elongate body of an absorbent material, the elongate body having opposite lateral ends;

(b) a handle at each opposite lateral end of the elongate body;

(c) a plurality of spaced-apart, rod-shaped pockets in the elongate body;

(d) a plurality of massage bars, each one being inserted in one of the pockets; and preferably (e) end seams extending transversely across opposite ends of the elongate body; and (f) a channel at each of the opposite ends of the elongate body, each channel being formed by the end seams; wherein each handle extends through one of the channels.

The handles are preferably ring-shaped and flexible, and are optionally removable. The massage bars are rigid, flexible, or a combination thereof. The massage bars are preferably removable, heatable, and microwavable.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
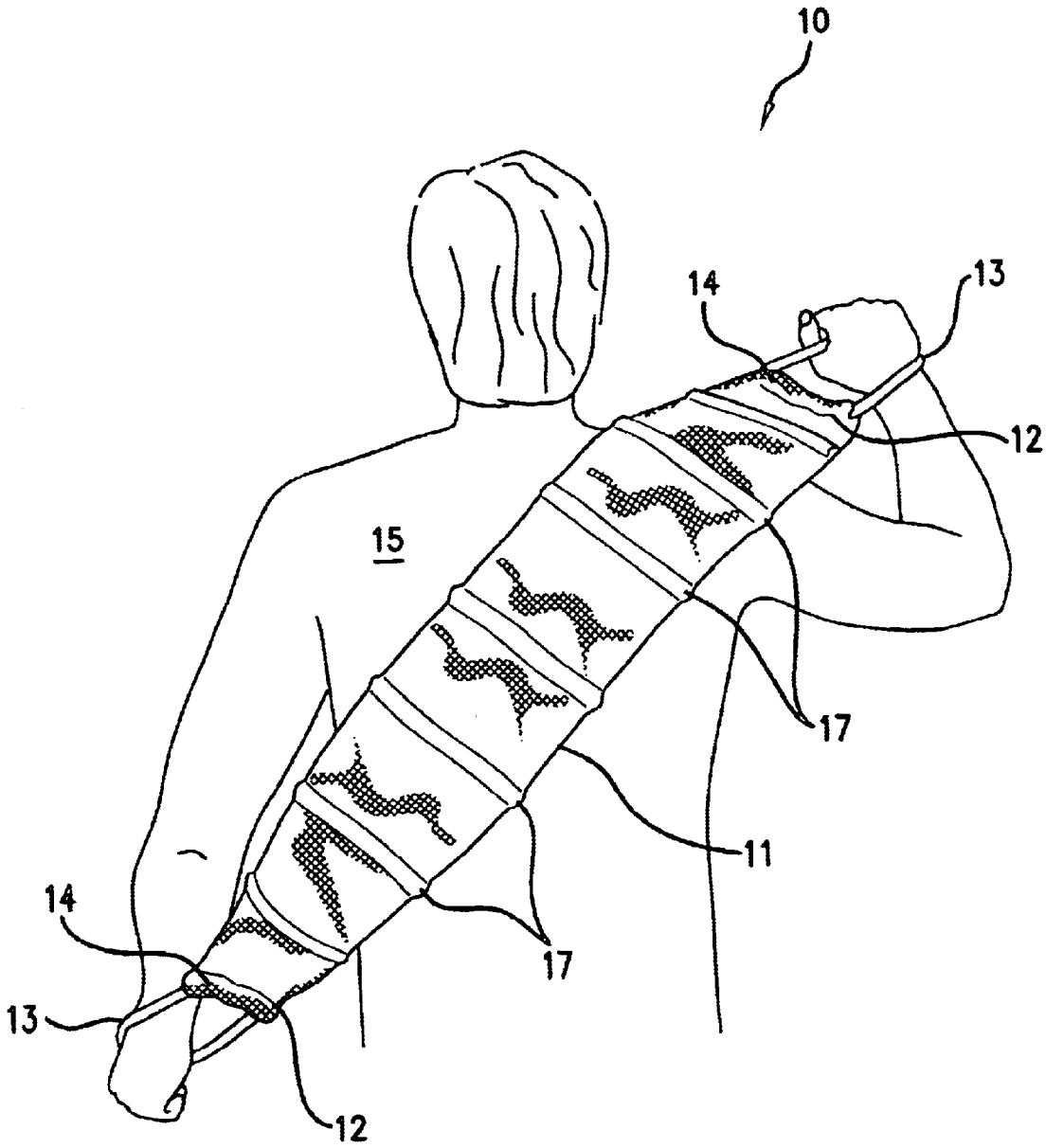
FIG. 1 shows a perspective view of a ribbed towel device according to the present invention, shown in use on a back.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, a ribbed towel device 10 is comprised of an elongate body 11 made of a single piece of absorbent material, such as terry cloth, which is folded in two along its longitudinal central axis. Alternatively, the elongate body 11 may be made of two identical, superimposed matching pieces of an absorbent material. The elongate body is preferably rectangular in shape, with two opposite lateral ends. It is preferably not a strap. In this preferred embodiment, substantially parallel, transverse end seams 12 at each lateral end of the elongate body 11 form matching end channels 14 through which a portion of each handle 13 passes. In use, the towel device 10 is pulled back and forth across a user's back 15 or any other hard to reach area of the body during or after a bath or shower ("bathing").

In FIG. 1, the handles 13 are ring-shaped and flexible. The handles 13 are also preferably removable. In one embodiment of the invention, the handles 13 are made of rope, preferably five-eighth (5/8) inch in diameter. The handle also provides an easy way to hang the towel device 10 on a hook on a wall.

Figure 2:
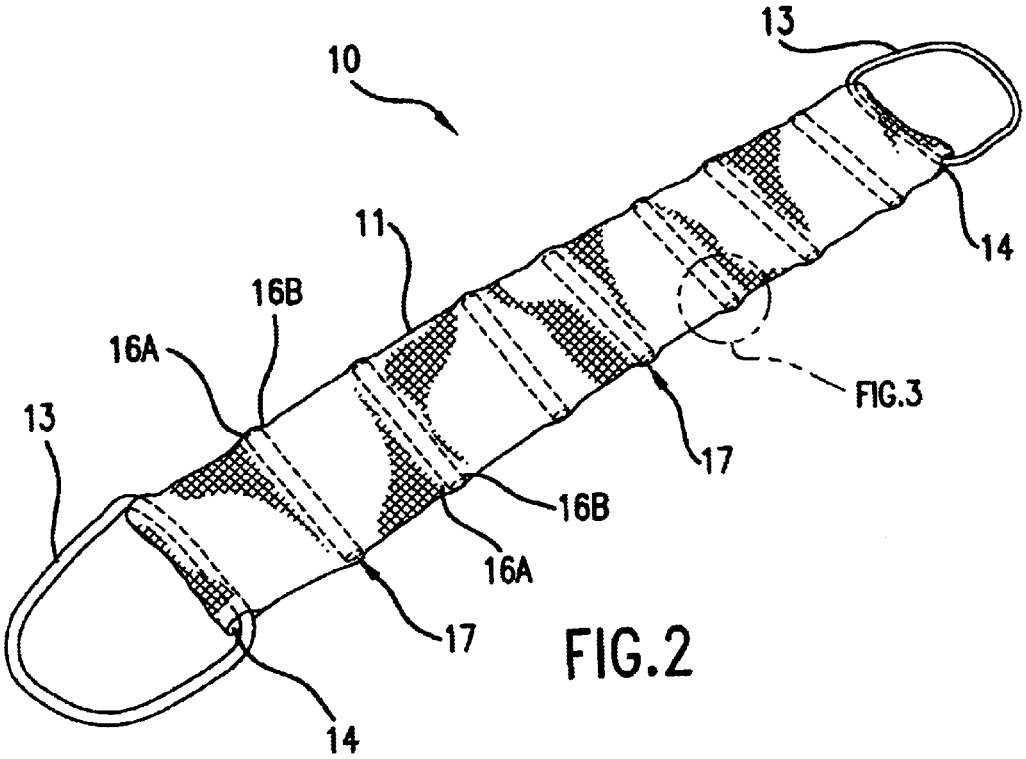
FIG. 2 is a perspective view of the ribbed towel device according to FIG. 1.

Turning to FIG. 2, the towel device 10 further comprises a plurality of sets of additional, substantially parallel, spaced-apart seams 16A, B between the two layers of material of the elongate body 11. The seams 16A, B are preferably generally perpendicular to a longitudinal axis of the elongate body 11, and each one preferably extends the width of the elongate body. In this preferred embodiment, the substantially parallel seams 16 are also linear. As shown in FIGS. 1 and 2, the substantially parallel seams 16 are located between the two end seams 12 and each set of the substantially parallel seams 16A, B forms a pocket 17.

Figure 3:
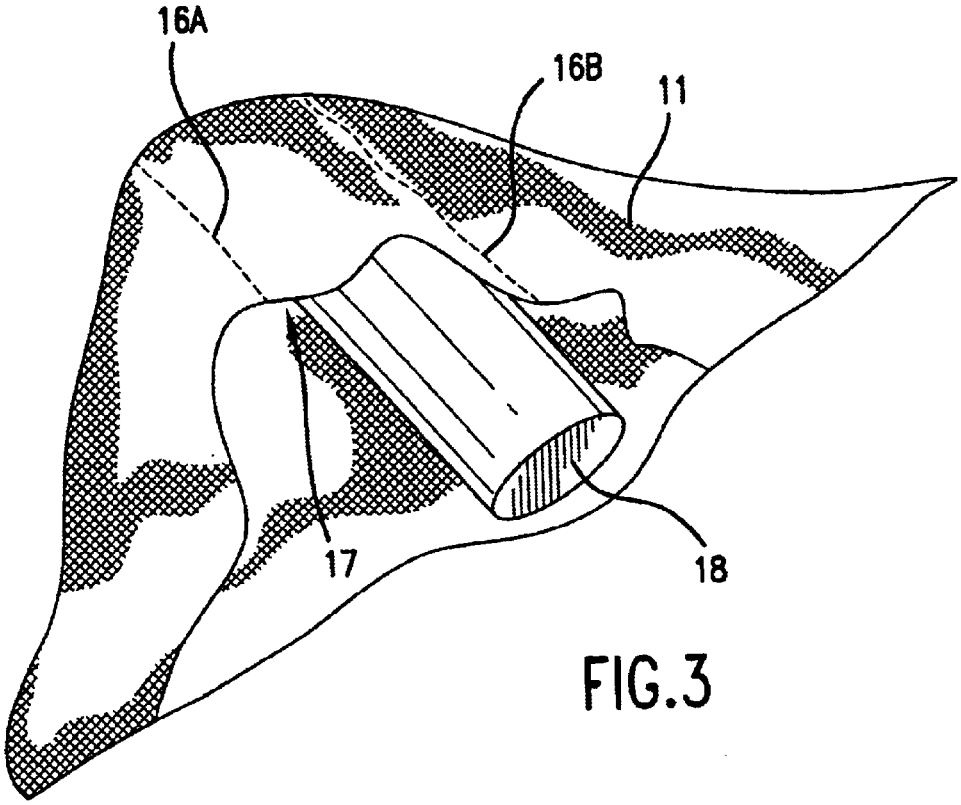
FIG. 3 is a perspective view of a cut-away enlargement of a section of the ribbed towel device shown in FIG. 2.

As shown in FIG. 3, each pocket 17 encloses a massage bar 18, hence the term "ribbed towel device". The massage bars 18 are preferably generally cylindrical in shape, and similar in size to the pockets and to one another. In this preferred embodiment, the matching, rod-shaped massage bars 18 in their pockets 17 are substantially parallel to one another. In this preferred embodiment, all of the massage bars 18 are substantially the same size, and each bar extends substantially the width of the towel device 10 within its corresponding pocket 17. The massage bars 18 may be flexible, rigid, or a combination thereof. For example, the massage bars 18 can be made of rope, wood, plastic, or a combination thereof. In one embodiment of the invention, the massage bars 18 are made of three (3) strand cotton rope that is about five-sixteenths of an inch (5/16") in diameter.

In use, the matching bars 18 massage the area of the body over which the ribbed towel device 10 is pulled. They also weight the towel device 10, so that it is easier to manipulate, and increase contact of the terry cloth or other towel material with the user's skin. The evenly distributed weight of the bars in the towel device 10 also makes it easier to hang the towel device over a bathtub edge or a shower stall before or after use. Because of the distributed weight of the bars 18, the towel device 10 is also easier to hang over the back of a chair on a piece of gym equipment, for example, than a conventional towel, which has a tendency to slide off. For this type of use, a more comfortable, flexible bar material is preferred, such as a soft plastic, spongy material, or a fluid-filled rubber-type material.

The massage bars 18 are preferably made of a durable, heatable, microwavable material, so that they can be heated to a safe temperature in a microwave just prior to insertion in the pockets 17 for a warm, pleasant effect on the skin during self-massage/drying. After use, the microwavable bars are removed from the pockets 17, so that the elongate body can be washed. Then the bars 18 can be reheated just prior to reinsertion in the pockets 17, and re-use of the towel device 10.

In the embodiment of the invention in which the elongate body 11 is made of a single piece that is folded in two along its longitudinal axis, the free, longitudinal edge of the elongate body 11 may be seamed, so the massage bars 18 are permanently enclosed in the pockets 17. However, in an alternate embodiment of the invention, the free, longitudinal edge of the elongate body 11 may be left open such that the massage bars 18 are removable for washing of the towel device 10.

The pockets 17 preferably open on one or both of the longitudinal edges of the towel device 10, but not the lateral ends of the towel device, which hold the handles 13. Preferably, the pockets 17 do not require securing flaps or the like on each pocket because each bar 18 fits closely into its pocket 17; therefore, the pockets do not require securing means to retain the bars in the pockets.

In the embodiment of the invention in which elongate body 11 is made of two superimposed matching pieces, one or both free, longitudinal edges of the elongate body 11 may be seamed, so the massage bars 18 are permanently enclosed in the pockets 17. Alternatively, both free edges of the elongate body 11 may be left open such that the massage bars 18 are removable from either side of the towel device for washing of the towel device 10. In yet another embodiment of this embodiment, one free edge of the elongate body 11 is seamed such that the massage bars 18 are removable.

When it is used after a bath, shower, steam bath, etc., the ribbed towel device 10 provides simultaneous massaging and drying of the body. It can also be used in the shower for massaging and abrading the skin.

Figure 4:
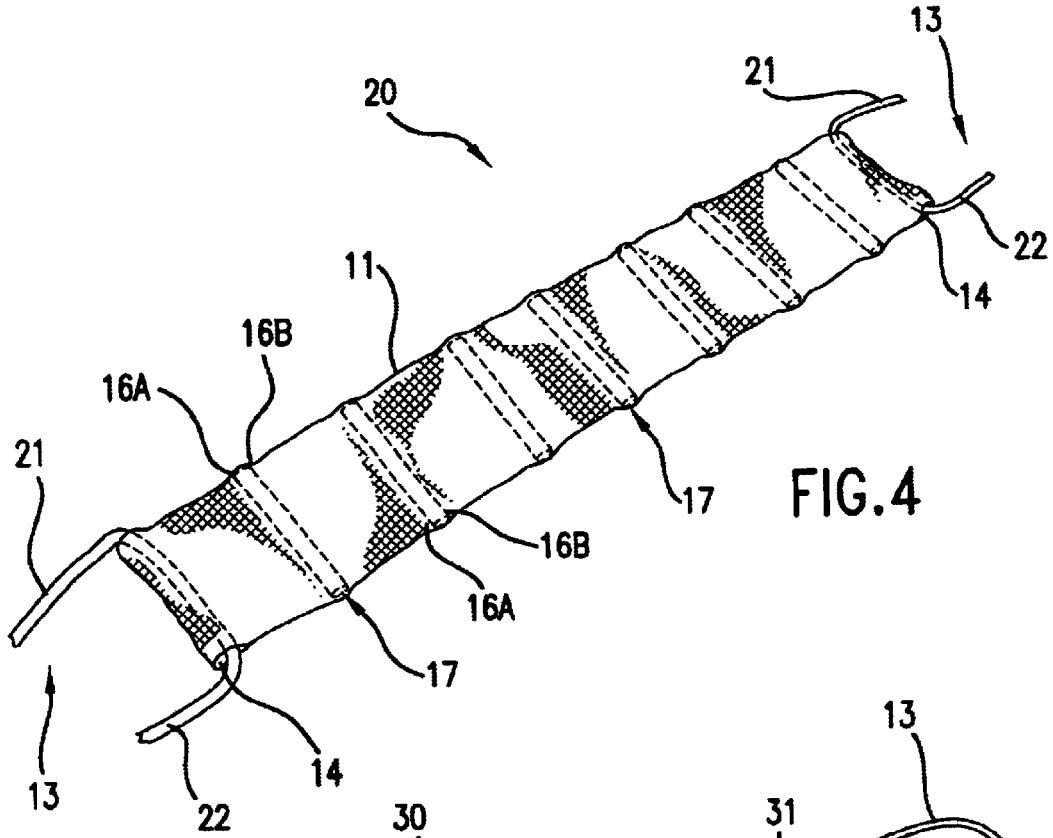
FIG. 4 is a perspective view of a second, alternate embodiment of a ribbed towel device according to the present invention, having two matching two-piece handles.

Turning to FIG. 4, an alternate embodiment of a ribbed towel device 20 includes two matching handles 13, each of which comprises a first component 21 and a second component 22, which are sewn or otherwise fused into the ends of the channels 14. The first component 21 and second component 22 are preferably flexible.

Figure 5:
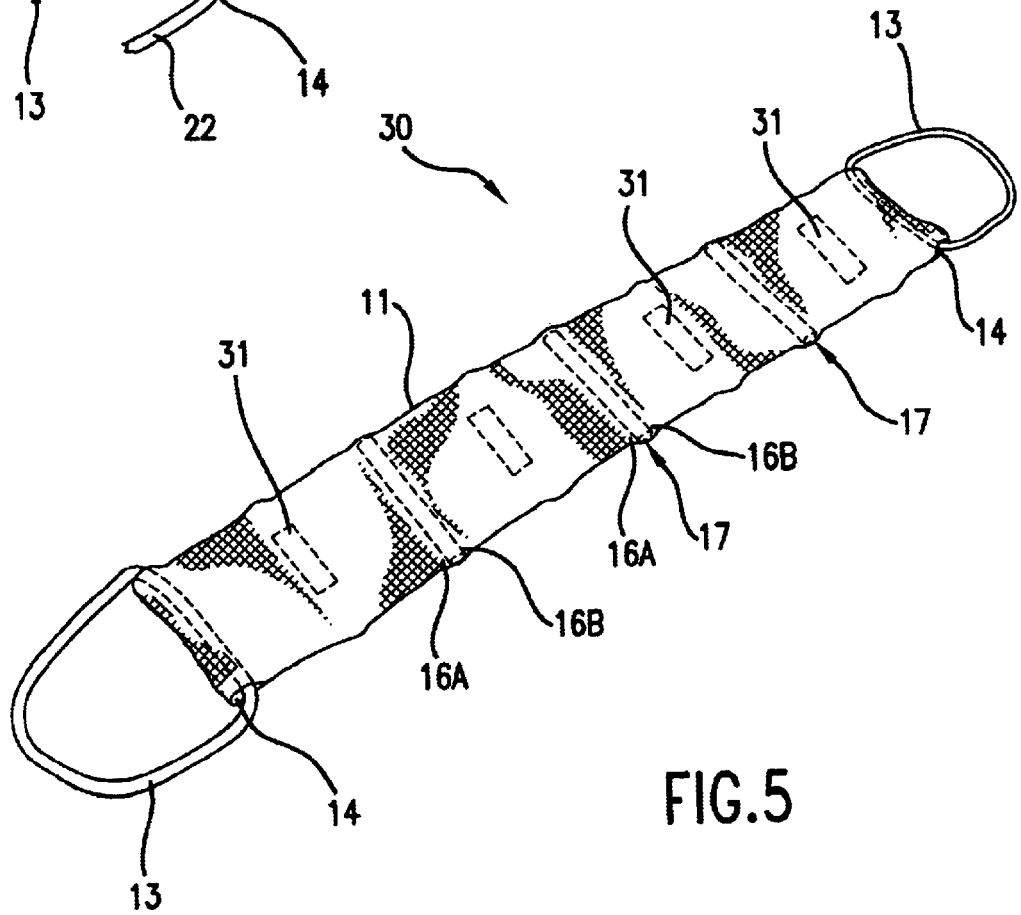
FIG. 5 is a perspective view of a third, alternate embodiment of a ribbed towel device according to the present invention, having fewer pockets with massage bars.

Referring to FIG. 5, an alternate embodiment of a ribbed towel device 30 has three pockets 17, each holding a massage bar 18. More or fewer pockets would also be acceptable. Between the pockets are plugs 31, which are smaller pieces of the bar material or another durable, comfortable material sewn or otherwise fused into the elongate body for weighting. The plugs 31 are preferably interspersed at central locations between the pockets 17, as shown in FIG. 5. The plugs 31 allow somewhat easier manipulation of the towel device. They also contribute to the massaging action when the towel device 30 is in use. The plugs may be magnets, or a magnetic material, sewn into the elongate body at approximately equal intervals, since magnets are thought by some to convey a healing property. The plugs may also be a scented material for providing a pleasant fragrance while the user is drying off.

Figure 6:
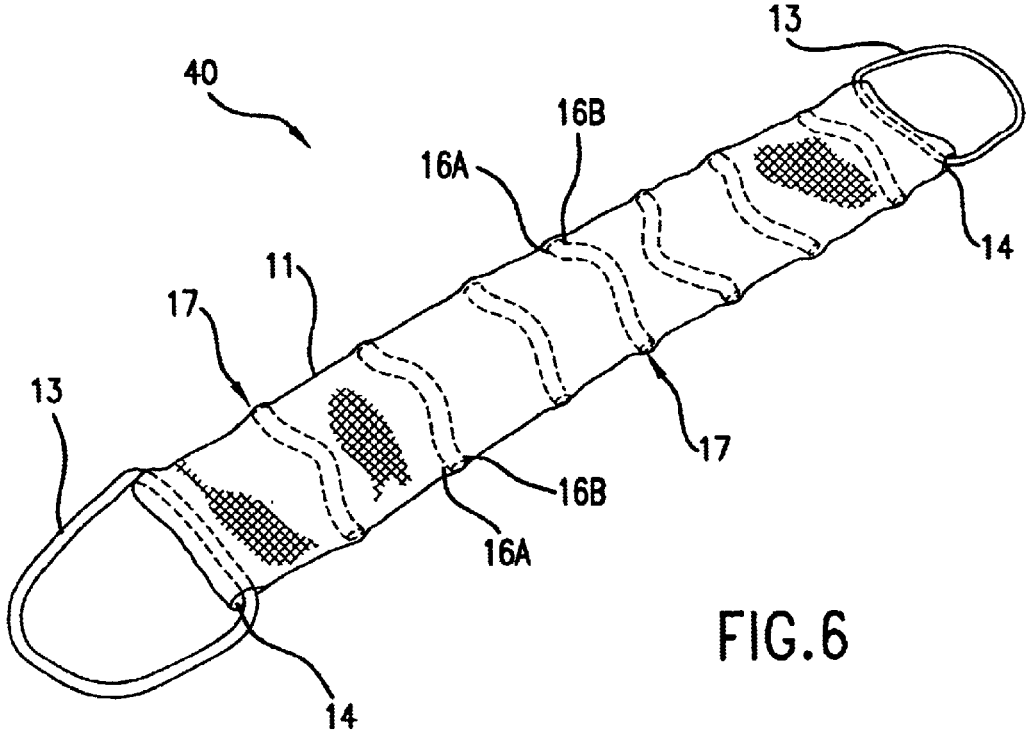
FIG. 6 is a perspective view of a fourth, alternate embodiment of a ribbed towel device according to the present invention, in which the seams and massage bars are irregular in shape.

FIG. 6 illustrates an alternate embodiment of a ribbed towel device 40 according to the present invention, in which the spaced-apart, substantially parallel seams 16A, B, as well as the massage bars within the pockets formed by the seams, are irregular in shape. It is believed that the curved shape of the massage bars contributes to the massaging action when the towel device is pulled back and forth across the back or other body area by the user.

Figure 7:
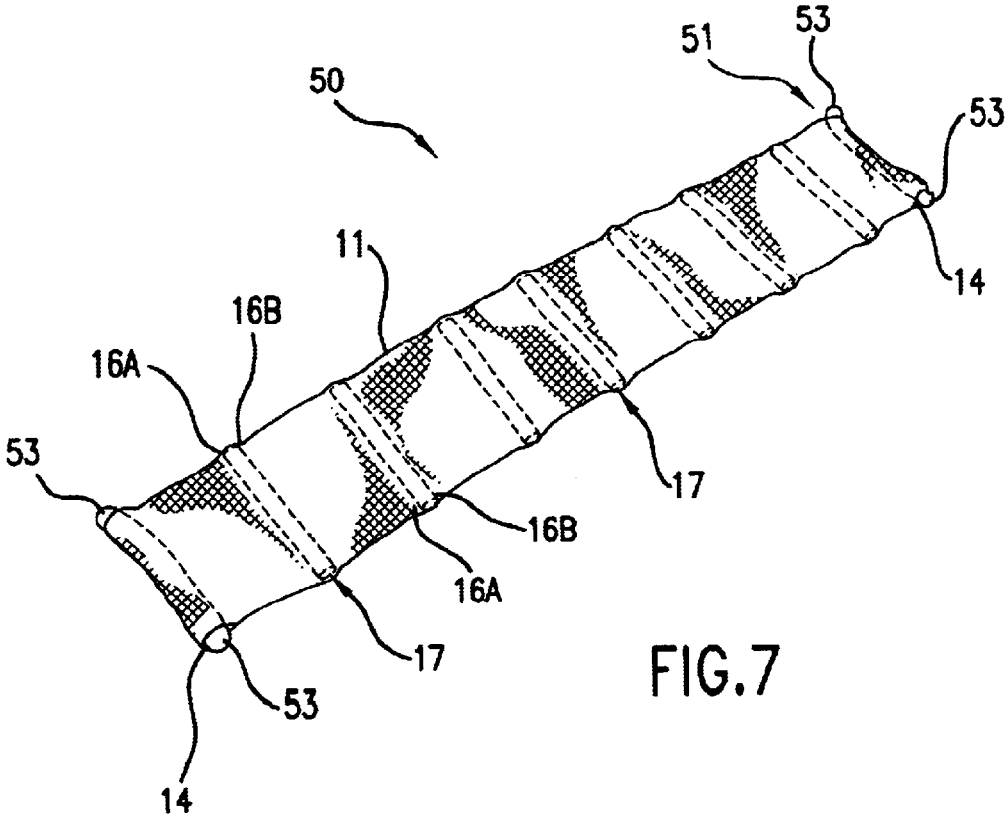
FIG. 7 is a perspective view of a fifth, alternate embodiment of a ribbed towel device according to the present invention, having bar-shaped handles.

Referring to FIG. 7, an alternate embodiment of a ribbed towel device 50 resembles the embodiment of FIG. 2, except that it includes bar-shaped handles 51 within the end channels 14 at opposite ends of the elongate body 11. The bar-shaped handles include removable end bars with bulbous opposite ends 53, each bulbous end bar being enclosed in an end channel 14, as shown in FIG. 7.

Figure 8:
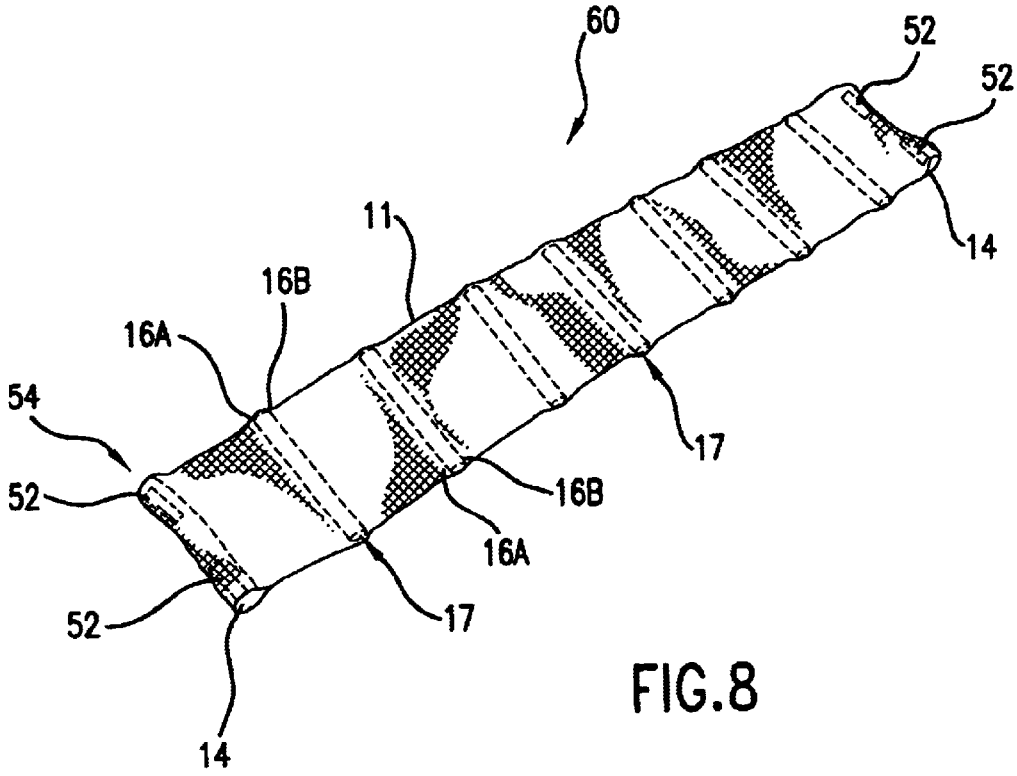
FIG. 8 is a perspective view of a sixth, alternate embodiment of a ribbed towel device according to the present invention, having bar-shaped handles.

Referring to FIG. 8, an alternate embodiment of a ribbed towel device 60 resembles the embodiment of FIG. 2, except that it includes a second embodiment of bar-shaped handles 54 within the end channels 14 at opposite ends of the elongate body 11. Two of the massage bars 17 are utilized, and the ends of the channels 14 include corresponding lock and loop patches 52, which are shown in outline in FIG. 8, for closing the end channels after the bars 17 have been inserted in the end channels 14.

Preferably, the elongate body 11 herein is not made of nylon or netting, nor does it require an overlay or second layer of nylon or netting. The pockets 17 are integral to the elongate body. Preferably, the pockets 17 are not openable, and the massage bars 18 are not removable. Preferably, the pockets 17 are not all-purpose, and only the massage bars 18 fit into the pockets. Special massage equipment is not required herein; the bars are simple rod-shaped bars.

From the foregoing it can be realized that the described ribbed towel device of the present invention may be easily and conveniently utilized during or after bathing. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ribbed towel device
11 elongate body
12 end seams
13 handles
14 end channels
15 user's back
16 substantially parallel seams
17 pockets
18 massage bars
20 second embodiment of towel device
21 first component
22 second component
30 third embodiment of towel device
31 plugs
40 fourth embodiment of towel device
50 fifth embodiment of towel device
51 first embodiment of bar-shaped handles
52 lock and loop patches
53 end bars with bulbous ends
54 second embodiment of bar-shaped handles
50 sixth embodiment of towel device

What is claimed is:

1. A ribbed towel device for massaging or drying hard-to-reach areas of the body during or after bathing, the towel device comprising:

(a) an elongate body of an absorbent material, the elongate body having opposite lateral ends;

(b) a handle at each opposite lateral end of the elongate body;

(c) a plurality of spaced-apart, rod-shaped pockets in the elongate body; and (d) a plurality of massage bars, each of the plurality of massage bars being inserted in one of the plurality of pockets.

2. The towel device according to claim 1, wherein the massage bars are removable.

3. The towel device according to claim 1, wherein each of the pockets is formed by a spaced-apart pair of substantially parallel seams extending across the elongate body.

4. The towel device according to claim 3, further comprising: (e) end seams extending transversely across opposite ends of the elongate body; and (f) a channel at each of the opposite ends of the elongate body, each channel being formed by the end seams; wherein each handle extends through one of the channels.

5. The towel device according to claim 4, wherein the elongate body is made of a single piece of material folded in two along a longitudinal axis of the single piece, and at least one longitudinal edge of the elongate body is seamed.

6. The towel device according to claim 5, wherein the pockets are not openable, and the bars are not removable.

7. The towel device according to claim 5, wherein the handles are ring-shaped and flexible.

8. The towel device according to claim 4, wherein the absorbent material is terry cloth, and the handles are made of rope.

9. The towel device according to claim 1, wherein the handles are removable.

10. The towel device according to claim 2, wherein the elongate body is comprised of two (2) superimposed matching pieces.

11. The towel device according to claim 1, wherein each of the massage bars is generally cylindrical in shape, and extends substantially the width of the towel device.

12. The towel device according to claim 11, wherein the massage bars are flexible, rigid, or a combination thereof.

13. The towel device according to claim 4, wherein each handle comprises a first component and a second component, an end of the first component being attached to an end of the channel, and an end of the second component being attached to another end of the channel.

14. The towel device according to claim 13, wherein the handles are made of cotton rope.

15. The towel device according to claim 1, wherein each one of the substantially parallel seams is linear.

16. The towel device according to claim 15, wherein the massage bars are made of plastic.

17. The towel device according to claim 4, wherein each one of the substantially parallel seams and each one of the massage bars within the pockets formed by the seams, is irregular in shape.

18. The towel device according to claim 1, wherein the handles are two of the plurality of massage bars in the two end channels, one of the massage bars extending through each of the end channels, opposite ends of the end channels comprising corresponding lock and loop patches for closing the ends of each channel after insertion of the massage bar.

19. The towel device according to claim 1, wherein the massage bars are made of a heatable, microwavable material.

20. The towel device according to claim 19, wherein each of the handles is comprised of a removable end bar with bulbous opposite ends, each of the end bars being substantially enclosed in one of the end channels.

* * * * *